US008602729B2

(12) United States Patent
Maccio' et al.

(10) Patent No.: US 8,602,729 B2
(45) Date of Patent: Dec. 10, 2013

(54) STEAM TURBINE STAGE

(75) Inventors: Mauro Maccio', Genoa (IT); Stefano Cecchi, Vado Ligure (IT); Francesco Malavasi, Sestri Levante (IT)

(73) Assignee: Ansaldo Energia S.p.A., Genoa (IT)

( * ) Notice: Subject to any disclaimer, the term of this patent is extended or adjusted under 35 U.S.C. 154(b) by 845 days.

(21) Appl. No.: 12/670,794

(22) PCT Filed: Jul. 27, 2007

(86) PCT No.: PCT/IT2007/000536

§ 371 (c)(1),
(2), (4) Date: Jun. 18, 2010

(87) PCT Pub. No.: WO2009/016657

PCT Pub. Date: Feb. 5, 2009

(65) Prior Publication Data

US 2010/0254809 A1 Oct. 7, 2010

(51) Int. Cl.
*F04D 29/44* (2006.01)

(52) U.S. Cl.
USPC ..... 415/199.1; 415/199.4; 415/199.5; 416/223 A; 416/238; 416/243

(58) Field of Classification Search
USPC ..... 415/199.1, 199.4, 199.5; 416/223 A, 416/238, 243, DIG. 2, DIG. 5
See application file for complete search history.

(56) References Cited

U.S. PATENT DOCUMENTS

| | | | | |
|---|---|---|---|---|
| 4,643,645 | A | 2/1987 | Robbins et al. | |
| 4,826,400 | A * | 5/1989 | Gregory | 415/181 |
| 5,211,703 | A * | 5/1993 | Ferleger et al. | 415/181 |
| 5,342,170 | A | 8/1994 | Elvekjaer et al. | |
| 5,791,873 | A | 8/1998 | Kreitmeier | |
| 5,868,553 | A * | 2/1999 | Battig et al. | 415/189 |
| 6,036,438 | A * | 3/2000 | Imai | 415/192 |
| 6,074,169 | A | 6/2000 | Siga et al. | |
| 6,182,439 | B1 | 2/2001 | Siga et al. | |
| 6,971,844 | B2 * | 12/2005 | Burdgick | 415/139 |
| 2004/0240986 | A1 | 12/2004 | Burdgick | |
| 2007/0014670 | A1 * | 1/2007 | Maeno | 416/232 |

FOREIGN PATENT DOCUMENTS

| | | |
|---|---|---|
| DE | 4228879 | 3/1994 |
| EP | 0799973 | 10/1997 |
| EP | 0831203 | 3/1998 |

(Continued)

OTHER PUBLICATIONS

JP63230904 Reference is a Translation of the Abrstract Title: Forced Cooling Device Of Steam Turbine Blade Inventors(s): Matsuura Osamu; Fujiwara Tadashi; and Tsuji Kunio Pertinent Pages=Abstract and Figures.*

*Primary Examiner* — Igor Kershteyn
(74) *Attorney, Agent, or Firm* — Greenblum & Bernstein, P.L.C.

(57) ABSTRACT

A stage of a steam turbine, having a rotor extending along a longitudinal axis, has a fixed stage and a movable stage arranged successively along a flow channel for feeding steam in a direction substantially parallel to the longitudinal axis; the fixed stage has an inner ring coaxial with the longitudinal axis, and a number of stator blades arranged radially about the inner ring; each stator blade is fixed to an annular top portion of the inner ring, which has a top surface facing the flow channel and crosswise to the longitudinal axis; and the movable stage has a number of rotor blades arranged radially about the rotor and fixed to the rotor.

18 Claims, 4 Drawing Sheets

(56) References Cited

FOREIGN PATENT DOCUMENTS

| | | |
|---|---|---|
| FR | 2568307 | 1/1986 |
| JP | 63-230904 | 9/1988 |
| JP | 10-103006 | 4/1998 |
| JP | 2001-221006 | 8/2001 |
| JP | 2007-023895 | 2/2007 |

* cited by examiner

STEAM TURBINE STAGE

TECHNICAL FIELD

The present invention relates to a steam turbine stage. More specifically, the present invention relates to the final stage of a steam turbine.

BACKGROUND ART

One known type of turbine comprises a rotor extending along a longitudinal axis; and a number of stages, each comprising a fixed stage and a movable stage. The fixed stage comprises a fixed inner ring; a fixed outer ring; and a number of so-called stator blades arranged radially between the inner ring and the outer ring, and fixed at one end to the inner ring, and at the other end to the outer ring. The movable stage comprises a number of so-called rotor blades arranged radially about the rotor and fixed to it by only one so-called base end.

Market demand in recent years has been for increasingly large steam turbines, to obtain high-efficiency, low-cost machines. More specifically, the tendency is towards increasing the size of the turbine exhaust section, i.e. the section at the final stage of the turbine, with the result that the final stage of a turbine of the type described above comprises extremely long stator blades, and extremely long rotor blades characterized by a marked twist along the blade axis. The twist provides for withstanding high pressure loads and large variations in steam flow speed, especially at the opposite end of each blade to the base.

The marked twist in the rotor blade, however, is not easy to produce, and involves considerable effort on the part of design engineers to minimize load losses along the rotor blade.

Moreover, large variations in steam flow speed, especially the tangential component, at the opposite end of the rotor blade to the base expose the surface of the rotor blade to serious damage by slow erosion caused by condensation dripping on the leading edge of the rotor blade.

DISCLOSURE OF INVENTION

It is an object of the present invention to provide a steam turbine stage designed to eliminate the aforementioned drawbacks of the known art. More specifically, it is an object of the invention to provide a steam turbine stage designed to reduce variations in the flow speed tangential component at the rotor blade, and which at the same time is cheap and easy to produce.

According to the present invention, there is provided a steam turbine stage as claimed in claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
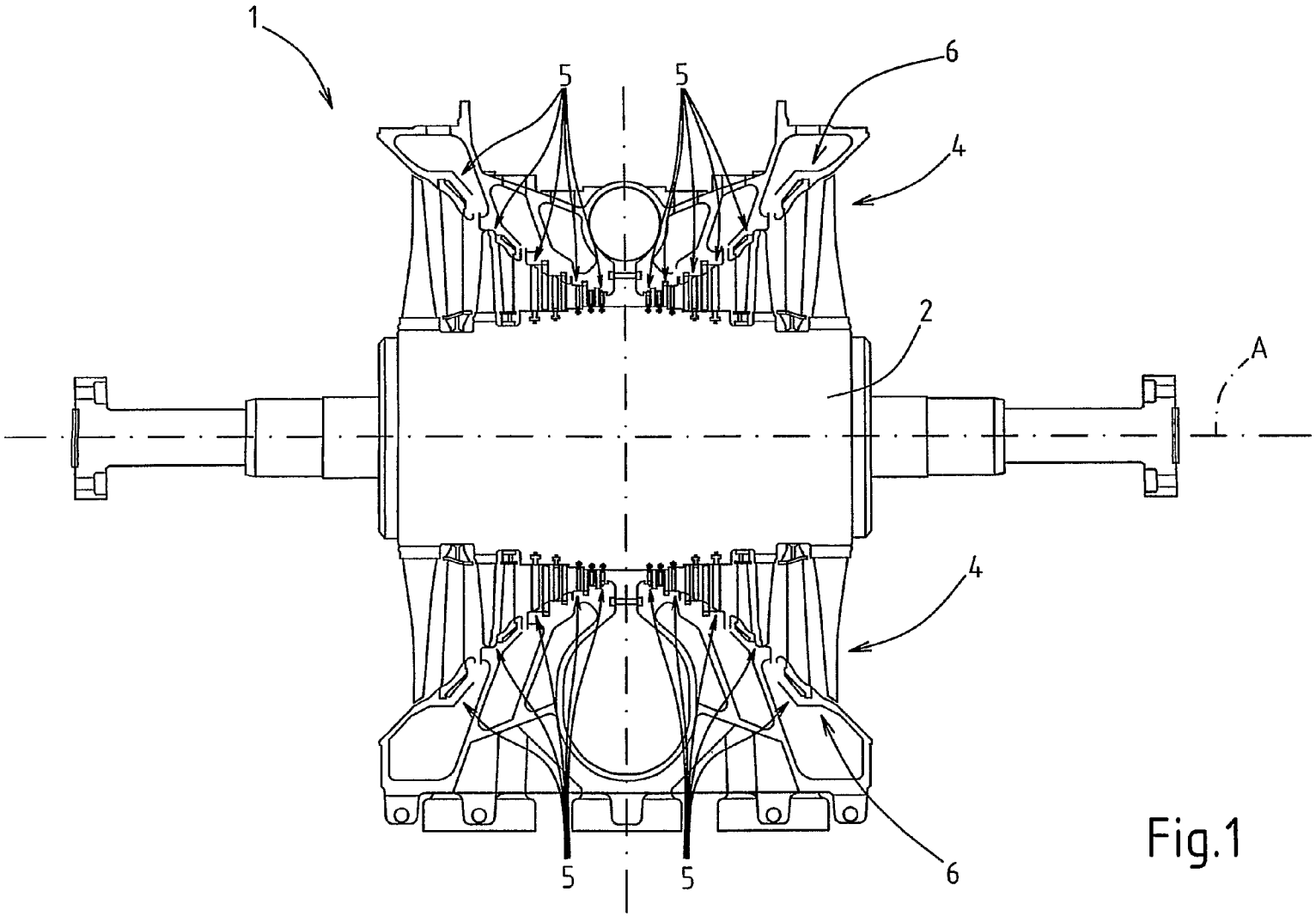
FIG. 1 shows a schematic, with parts in section and parts removed for clarity, of a steam turbine.

Number 1 in FIG. 1 indicates a steam turbine extending along a longitudinal axis A and comprising a rotor 2 rotating about axis A; a flow channel 4 for steam flow in a direction D substantially parallel to longitudinal axis A; and a number of stages 5 arranged successively along flow channel 4. More specifically, steam turbine 1 in the non-limiting embodiment shown in the accompanying drawings is a low-pressure steam turbine.

Figure 2:
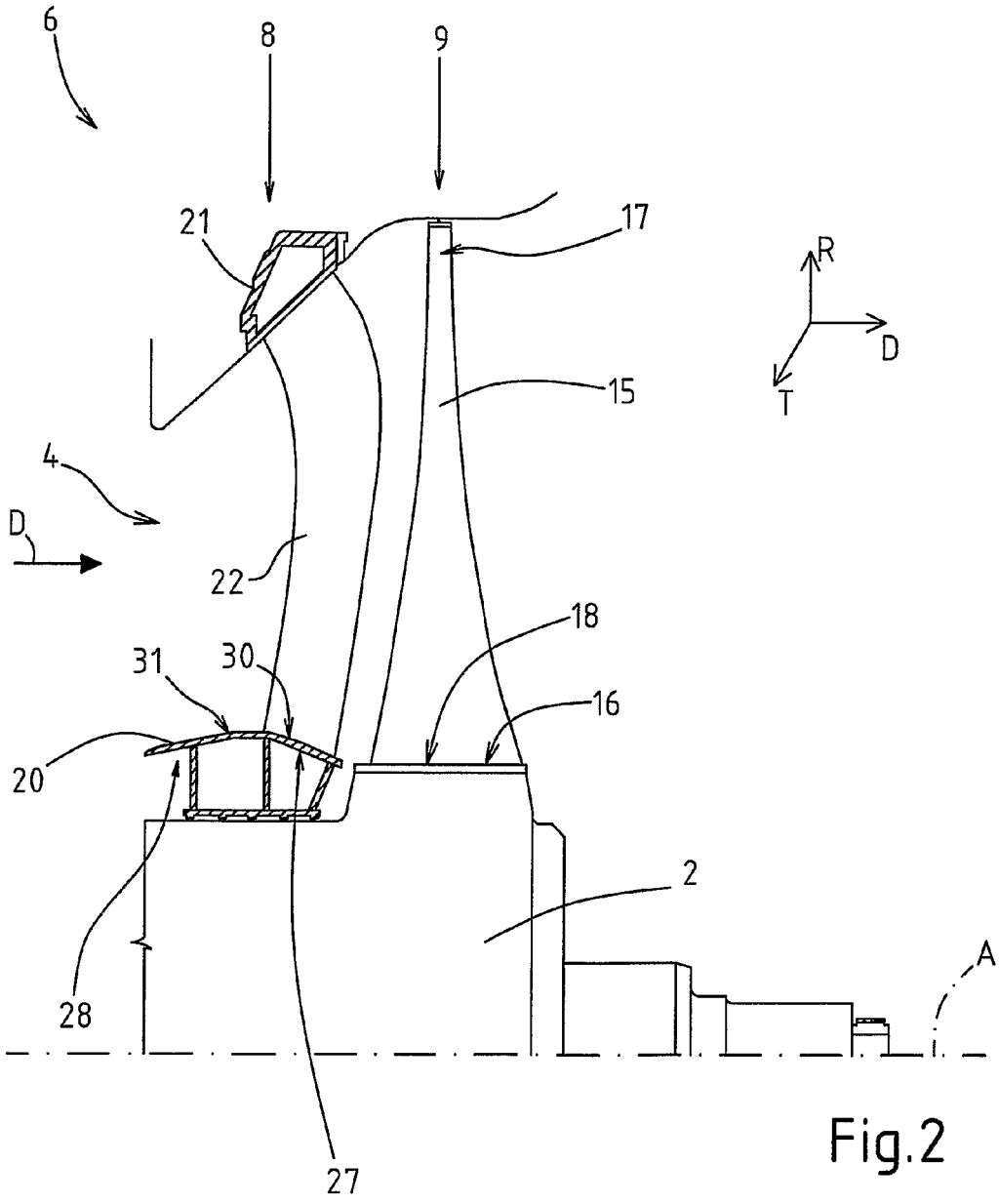
FIG. 2 shows a schematic side view, with parts in section and parts removed for clarity, of a steam turbine stage in accordance with the present invention.

Number 6 in FIG. 2 indicates a final stage of steam turbine 1, though any one of stages 5 of turbine 1 may be considered.

Stage 6 comprises a fixed stage 8 and a movable stage 9 arranged successively along flow channel 4 in direction D.

Movable stage 9 comprises a number of rotor blades 15 arranged radially about rotor 2.

Each rotor blade 15 comprises a base 16 fixed to rotor 2; and a free end 17 opposite base 16. More specifically, rotor 2 has an annular rotor surface 18 facing flow channel 4 and to which rotor blades 15 are fixed.

In actual use, rotor blades 15 are driven by rotor 2 rotating about axis A.

Fixed stage 8 comprises an inner ring 20 and an outer ring 21, both coaxial with longitudinal axis A; and a number of stator blades 22 arranged radially between inner ring 20 and outer ring 21.

Figure 3:
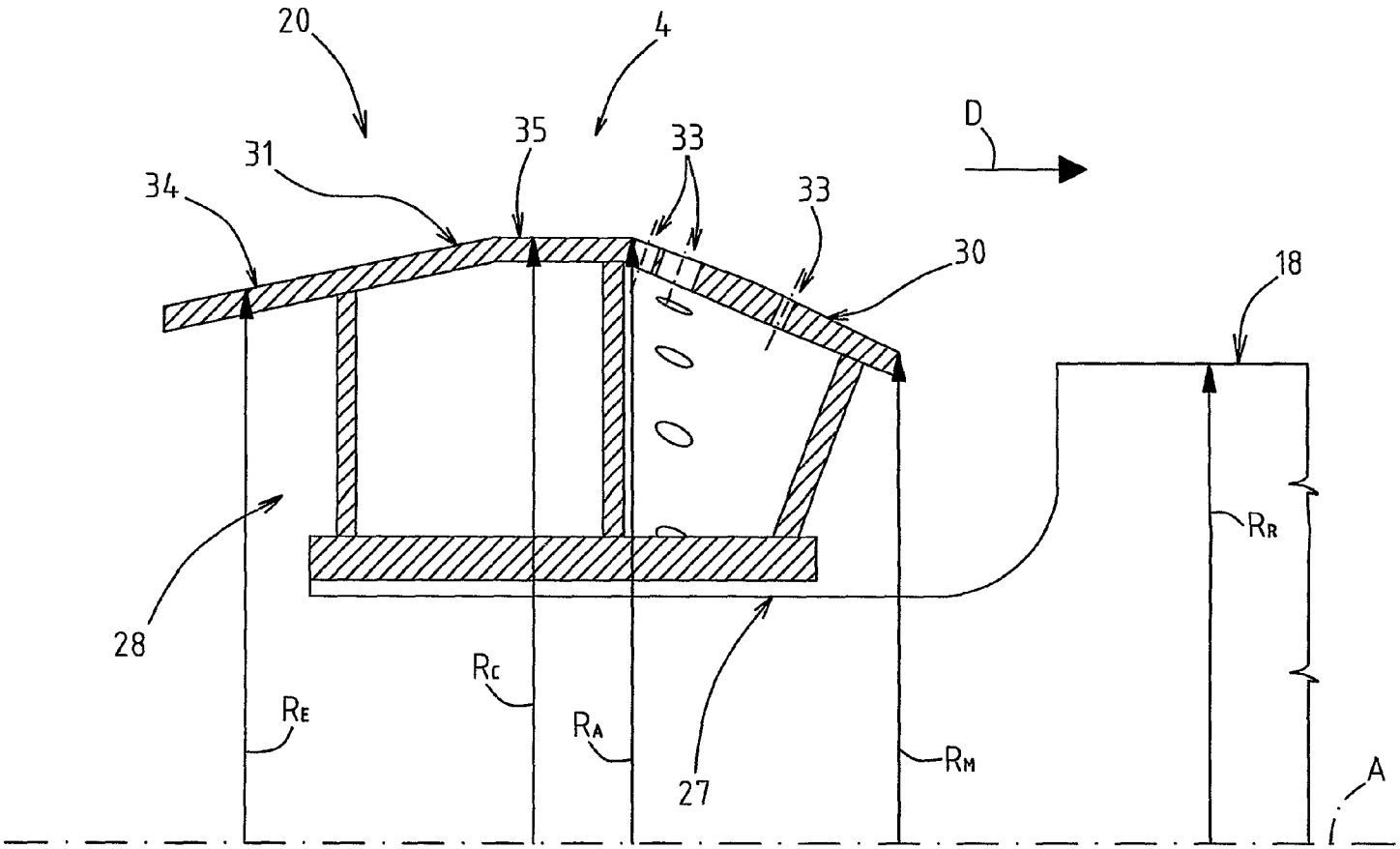
FIG. 3 shows a side view, with parts in section and parts removed for clarity, of a detail of the FIG. 2 stage.

With particular reference to FIG. 3, inner ring 20 comprises an annular top portion 27, to which stator blades 22 are fixed; and an annular portion 28.

Annular top portion 27 has a top surface 30 facing steam flow channel 4; and annular portion 28 has a surface 31 also facing channel 4. More specifically, top surface 30 has holes 33 for disposing of condensation formed inside stator blade 22, and substantially has a radius $R_A$—meaning the distance from longitudinal axis A—decreasing along the steam flow direction D. More specifically, the minimum radius $R_M$ of top surface 30 substantially equals the constant radius $R_R$ of annular rotor surface 18; and top surface 30 is preferably convex to form a sort of "bulge".

Surface 31 comprises an end area 34 whose radius $R_E$ increases gradually in steam flow direction D; and a central area 35 located between end area 34 and top surface 30, and whose radius $R_C$ is constant in steam flow direction D.

Inner ring 20 and outer ring 21 are preferably hollow, and respectively comprise two half-rings (not shown), which can be split to insert rotor 2, and are formed by joining appropriately shaped metal sheets to obtain a strong box form capable of effectively withstanding aerodynamic loads.

More specifically, the form of top surface 30 is obtained by an appropriately worked single metal wall having through holes 33.

Figure 4:
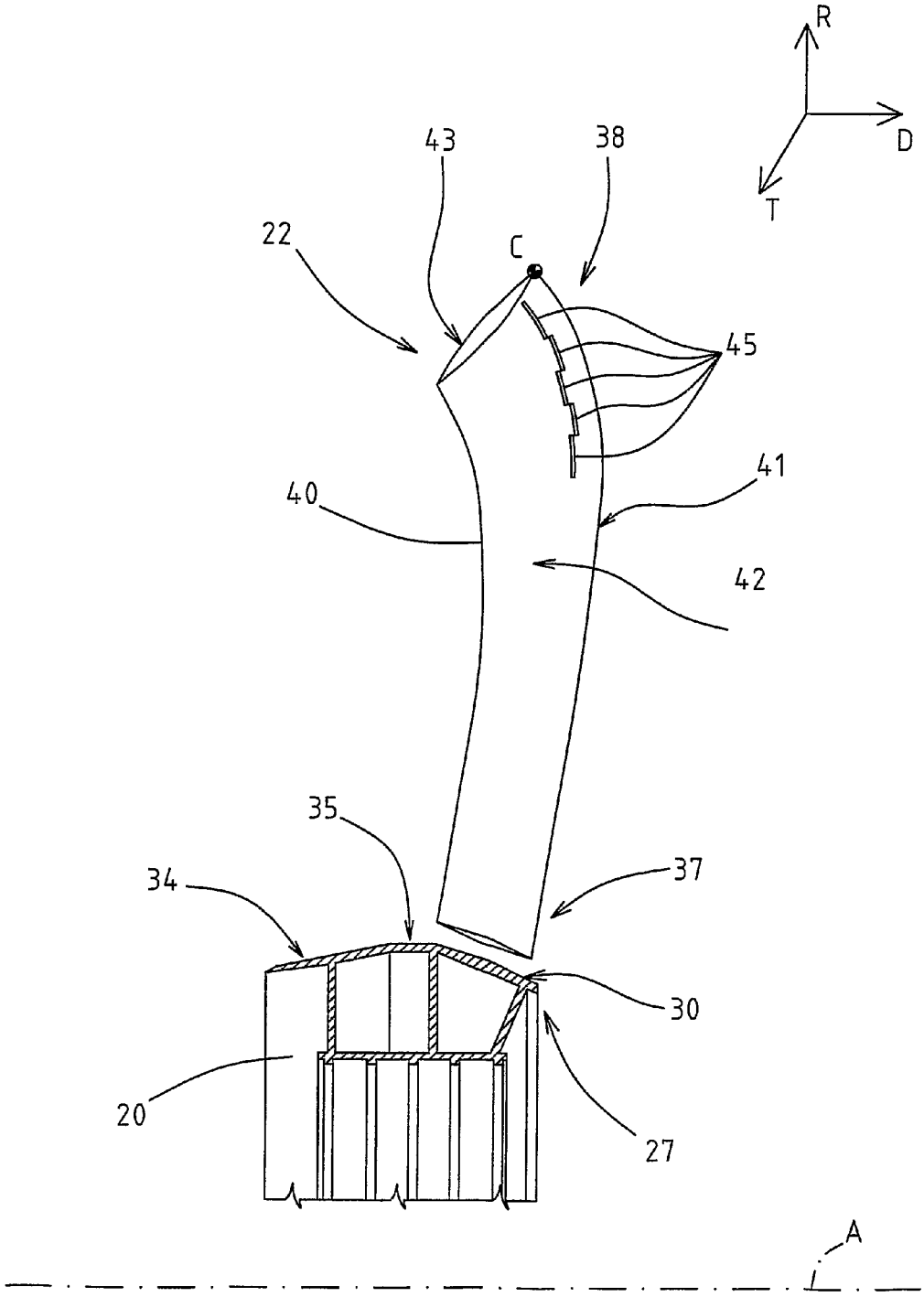
FIG. 4 shows an exploded view in perspective, with parts in section and parts removed for clarity, of a detail of the FIG. 2 stage.

With reference to FIG. 4, each stator blade 22 comprises a first end or hub 37 fixed to top portion 27; a second end or tip 38 opposite first end 37 and fixed to outer ring 21 (FIG. 2); a leading edge 40; a trailing edge 41 opposite leading edge 40; and a suction side or topside 42 and a pressure side or underside 43, both extending between leading edge 40 and trailing edge 41.

Each stator blade 22 is a hollow body made of two appropriately shaped metal sheets welded at the ends close to leading edge 40 and trailing edge 41.

Hub 37 of each stator blade 22 has a profile complementary to top surface 30. And the shape of hub 37 and top surface 30 reduces the aerodynamic load on hub 37 of each stator blade 22, and the Mach number of each stator blade 22, i.e. the ratio of local steam speed to the speed of sound measured at the same point.

A first projection of trailing edge 41 of each stator blade 22, in a plane through longitudinal axis A and stator blade 22, is curved. More specifically, the first projection is concave in the opposite direction to flow direction D.

The first projection is known as "sweep"; and the degree of curvature of the sweep depends on dimensional factors, mainly: geometric interference between inner ring 20 and rotor 2; minimizing the distance between stator blade 22 and movable blade 15; and the compulsory right-angle of tip 38 to outer ring 21.

In the example shown, the sweep is a sixth-order curve.

The sweep increases the capacity of stator blade 22 and, therefore, of stage 6 of which it forms part; capacity being intended to mean the amount of steam that can be disposed of, with given conditions upstream and downstream from stage 6.

The sweep also alters the Mach number of each stator blade 22, which is reduced at hub 37 and increased at tip 38. The load on stator blade 22 is less where the Mach number is reduced, and greater where the Mach number is increased with respect to the reference case.

The variation in aerodynamic load distribution can also be determined on the basis of the variation in the steam outflow angle, with respect to direction D, of stator blade 22. In the case in question, the outflow angle is reduced at hub 37 with respect to the reference angle, and increased at tip 38, so that, as stated, the load on stator blade 22 is greater at tip 38 than at hub 37. The above aerodynamic design of stator blades 22 also reduces the inflow angle at base 16 of each rotor blade 15, whereas the flow angle at free end 17 remains practically unchanged. At the design stage, the change in the inflow angle of rotor blade 15 translates to a reduction in "twist", i.e. the extent to which rotor blade 15 twists about its axis, from base 16 to free end 17.

A second projection of trailing edge 41 of each stator blade 22, in a plane perpendicular to longitudinal axis A, is curved. More specifically, the second projection of trailing edge 41 is concave with respect to the rotation direction of rotor 2.

The second projection is known as "lean"; and the degree of curvature is limited to avoid an excessive increase in length of stator blade 22, and uneven load distribution concentrated at tip 38.

In the example shown, the lean is a third-order curve.

The lean has a more localized effect than the sweep, by reducing the Mach number at hub 37 of each stator blade 22, and slightly increasing the Mach number at tip 38.

With reference to FIG. 3, each stator blade 22 also has a number of slots 45 formed along an isobar on both pressure side 43 close to trailing edge 41 and tip 38. More specifically, slots 45 are roughly seven in number, extend from tip 38 along roughly 40% of the height of stator blade 22, and provide for collecting condensation droplets forming on the surface of stator blade 22 as steam flows through final stage 6. In actual use, the condensation droplets through slots 45 are fed through holes 33 in inner ring 20 and along pipes (not shown) to the condenser (not shown).

The present invention has the following advantages.

In particular, stage 6 as described provides for reducing its own aerodynamic losses.

Reducing load at hub 37 of each stator blade 22 results directly in an increase in load at base 16 of each rotor blade 15. This brings about an increase of the degree of reaction of the stage at hub 37 and base 16—where "reaction" is intended to mean the ratio of the total enthalpic increase on rotor blade 15 to the total enthalpic increase of stage 6. The effect on the reaction, accompanying the localized effects on the individual blades, results in an increase in efficiency of stage 6 (the ratio of the total enthalpic increase of the stage to the total enthalpic increase, assuming isentropic transformation between the inlet and outlet of the stage).

Increasing load at base 16 of each rotor blade 15 enables a reduction in the twist of rotor blades 15, which are therefore easier to design and produce.

Clearly, changes may be made to the stage as described herein without, however, departing from the scope of the accompanying Claims.

The invention claimed is:

1. A stage of a steam turbine having a rotor extending along a longitudinal axis, the stage comprising a fixed stage and a movable stage arranged successively along a flow channel for feeding steam in a direction substantially parallel to the longitudinal axis, the fixed stage comprising:

an inner ring coaxial with the longitudinal axis and comprising an annular portion having a surface facing the flow channel, the surface comprising:

an end area whose radius increases gradually in the flow direction, and a central area having a constant radius in the flow direction; and a number of stator blades arranged radially about the inner ring, each stator blade being fixed to an annular top portion of the inner ring, which has a top surface facing the flow channel, wherein:

the movable stage comprises a number of rotor blades arranged radially about the rotor and fixed to one end of the rotor, the top surface of the annular top portion is crosswise to the longitudinal axis, the annular portion is adjacent to the annular top portion upstream from the annular top portion in the flow direction, and the central area is located between the end area and the top surface.

2. A stage as claimed in claim 1, characterized in that the rotor has an annular rotor surface facing the flow channel; the top surface converging with the annular rotor surface.

3. A stage as claimed in claim 1, characterized in that the radius of the top surface decreases gradually in the flow direction.

4. A stage as claimed in claim 2, characterized in that the minimum radius of the top surface substantially equals the radius of the annular rotor surface; the radius of the annular rotor surface being constant in the flow direction.

5. A stage as claimed in claim 1, characterized in that the top surface is convex.

6. A stage as claimed in claim 1, characterized in that the inner ring is hollow.

7. A stage as claimed in claim 1, characterized in that the inner ring comprises a metal wall shaped to form the top surface.

8. A stage as claimed in claim 1, characterized in that the inner ring comprises two half-rings connected to each other.

9. A stage as claimed in claim 1, characterized in that each stator blade comprises a first end connectable to the annular top portion of the inner ring; the stator blade having a profile substantially complementary to the top surface.

10. A stage as claimed in claim 1, characterized in that each stator blade comprises a second end connected to an outer ring of the fixed stage coaxial with the longitudinal axis; each stator blade comprising a leading edge; a trailing edge opposite the leading edge and downstream from the leading edge in the flow direction; a suction side; and a pressure side; the suction side and pressure side extending between the leading edge and the trailing edge.

11. A stage as claimed in claim 10, wherein a sweep of the trailing edge of each stator blade, in a plane through the longitudinal axis and said stator blade, is curved.

12. A stage as claimed in claim 11, wherein the sweep of the trailing edge is concave in a direction opposite the flow direction.

13. A stage as claimed in claim 10, wherein a lean of the trailing edge of each stator blade, in a plane perpendicular to the longitudinal axis, is curved.

14. A stage as claimed in claim 13, wherein the lean of the trailing edge is concave with respect to the rotation direction of the rotor.

15. A stage as claimed in claim 11, wherein the sweep is a sixth-order curve.

16. A stage as claimed in claim 13, wherein the lean is a third-order curve.

17. A stage as claimed in claim 1, characterized in that the stage is the final stage of a steam turbine.

18. A low-pressure steam turbine, characterized by comprising a stage as claimed in claim 1.

* * * * *